US008888549B2

(12) United States Patent
Lo

(10) Patent No.: US 8,888,549 B2
(45) Date of Patent: Nov. 18, 2014

(54) BUBBLE GENERATING APPARATUS WITH SHUTTER

(75) Inventor: Wai Chung Lo, Hong Kong (CN)

(73) Assignee: Wing Hing Manufacturing Co. Ltd., Hong Kong (HK)

( * ) Notice: Subject to any disclaimer, the term of this patent is extended or adjusted under 35 U.S.C. 154(b) by 462 days.

(21) Appl. No.: 13/274,888

(22) Filed: Oct. 17, 2011

(65) Prior Publication Data

US 2012/0270462 A1 Oct. 25, 2012

Related U.S. Application Data

(60) Provisional application No. 61/410,765, filed on Nov. 5, 2010.

(51) Int. Cl.
*A63H 33/28* (2006.01)

(52) U.S. Cl.
CPC ..... *A63H 33/28* (2013.01)
USPC ..... 446/15; 446/16

(58) Field of Classification Search
USPC ..... 446/15, 16, 17, 18, 19, 20, 21
See application file for complete search history.

(56) References Cited

U.S. PATENT DOCUMENTS

| | | | | |
|---|---|---|---|---|
| 2,553,388 | A | 5/1951 | Steiner | |
| 2,720,723 | A * | 10/1955 | Peretti | 446/15 |
| 3,210,790 | A * | 10/1965 | Neumann | 15/118 |
| 3,398,479 | A | 8/1968 | Rave | |
| 3,834,066 | A | 9/1974 | Vargas | |
| 5,462,469 | A * | 10/1995 | Lei | 446/15 |
| 5,498,191 | A | 3/1996 | Demars | |
| 5,613,890 | A | 3/1997 | Demars | |
| 5,797,385 | A | 8/1998 | Thai | |
| 6,102,764 | A | 8/2000 | Thai | |
| 6,139,391 | A | 10/2000 | Thai | |
| 6,149,486 | A | 11/2000 | Thai | |
| 6,315,627 | B1 | 11/2001 | Thai | |
| 6,331,130 | B1 | 12/2001 | Thai | |
| 6,439,944 | B1 * | 8/2002 | La Fata | 446/15 |
| 6,572,427 | B1 * | 6/2003 | Thai | 446/15 |
| 6,595,822 | B1 | 7/2003 | Thai | |
| 6,616,498 | B1 * | 9/2003 | Thai | 446/15 |
| 6,620,016 | B1 * | 9/2003 | Thai | 446/15 |
| 6,659,830 | B2 * | 12/2003 | Thai | 446/15 |
| 6,893,314 | B2 * | 5/2005 | Thai | 446/15 |
| 6,969,293 | B2 * | 11/2005 | Thai | 446/15 |
| 6,988,926 | B2 * | 1/2006 | Thai | 446/15 |
| 7,056,182 | B2 * | 6/2006 | Wan | 446/15 |
| 7,182,665 | B2 * | 2/2007 | Thai | 446/15 |
| 7,223,149 | B2 * | 5/2007 | Thai | 446/15 |

(Continued)

OTHER PUBLICATIONS

Supplemental European Search Report in European Patent Application No. 11187574 dated Apr. 2, 2012.

*Primary Examiner* — Gene Kim
*Assistant Examiner* — Joseph B Baldori
(74) *Attorney, Agent, or Firm* — Baker & McKenzie LLP

(57) ABSTRACT

Disclosed embodiments include a bubble generating apparatus operable to generate bubbles from a bubble generating liquid. In an exemplary embodiment, the exemplary bubble generating apparatus includes a symmetric output assembly having a bubble formation surface and a central opening defined therethrough. A liquid film may be formed across the central opening of the bubble formation surface, and air flow may be provided through the central opening of the bubble formation surface to generate bubbles from the liquid film.

16 Claims, 14 Drawing Sheets

(56) References Cited

U.S. PATENT DOCUMENTS

| | | | | |
|---|---|---|---|---|
| 7,367,861 | B2 * | 5/2008 | Thai | 446/15 |
| 8,267,736 | B2 * | 9/2012 | Lam | 446/19 |
| 2003/0116224 | A1 | 6/2003 | Crawford | |
| 2004/0142626 | A1 * | 7/2004 | Choi | 446/15 |
| 2004/0266309 | A1 * | 12/2004 | Thai | 446/15 |
| 2007/0037467 | A1 * | 2/2007 | Thai | 446/15 |
| 2007/0275630 | A1 * | 11/2007 | Thai | 446/15 |
| 2009/0142986 | A1 * | 6/2009 | San | 446/15 |

* cited by examiner

BUBBLE GENERATING APPARATUS WITH SHUTTER

CROSS-REFERENCES TO RELATED APPLICATION

The present application is a non-provisional application of U.S. Provisional Patent Application No. 61/410,765 filed Nov. 5, 2011 entitled "Bubble generating apparatus with shutter," which is incorporated herein by reference in its entirety as set forth in full.

TECHNICAL FIELD

The present disclosure relates to a bubble generating apparatus and more particularly to a bubble generating apparatus having a shutter mechanism operable to form bubbles from bubble generating liquid.

BACKGROUND

There are many different types of bubble generating mechanisms. In one approach, a film of bubble generating liquid is formed across a ring, and air is directed through the opening in the ring to form bubbles. Such an approach may be embodied in a variety of final products, such as a stationary bubble machine or a hand-held apparatus. The final product may include a variety of components, depending on various design needs.

SUMMARY

An exemplary embodiment in accordance with the present disclosure is directed to a bubble generating apparatus comprising a housing comprising an internal chamber, an end portion, and a housing opening opposite the end portion. The disclosed apparatus may further include an output assembly coupled to the housing. In an embodiment, the output assembly comprises a bubble formation surface having an aperture defined therethrough, the bubble formation surface being operable to receive a liquid through the aperture, wherein the liquid is operable to spread across a central opening defined in the bubble formation surface. The output assembly may also include first and second shutter flaps, wherein each shutter flap is operable to pivotably rotate from a first orientation to a second orientation. When the first and second shutter flaps are in their respective first orientations, an edge of the first shutter flap is adjacent to an edge of the second shutter flap, and the first and second shutter flaps are proximate to the bubble formation surface. When the first and second shutter flaps are in their respective second orientations, an air flow may be directed along a path through the central opening of the bubble formation surface and through the housing opening.

Another exemplary embodiment in accordance with the present disclosure is directed to a bubble generating apparatus comprising a housing comprising an internal chamber, an end portion, and a housing opening opposite the end portion. The disclosed apparatus may further include an output assembly coupled to the housing. In an embodiment, the output assembly comprises a bubble formation surface having an aperture defined therethrough, the bubble formation surface being operable to receive a liquid through the aperture, wherein the liquid is operable to spread across a central opening defined in the bubble formation surface. The output assembly may also include first and second shutter flaps, wherein each shutter flap is operable to pivotably rotate from a first orientation to a second orientation. When the first and second shutter flaps are in their respective first orientations, an edge of the first shutter flap is adjacent to an edge of the second shutter flap, and the first and second shutter flaps are proximate to the bubble formation surface. When the first and second shutter flaps are in their respective second orientations, an air flow may be directed along a path through the central opening of the bubble formation surface and through the housing opening. The disclosed apparatus may further include a motor mounted in an internal chamber of the housing and a fan mounted in the internal chamber of the housing, the fan being driven by the motor and operable to direct the air flow through the central opening of the output assembly. In an embodiment, the disclosed apparatus may further include a reservoir removably connected to the housing, the reservoir operable to store the liquid; a flexible tube having a first end extending into the reservoir and a second end connected to the aperture in the bubble formation surface; and a pumping mechanism driven by the motor, the pumping mechanism operable to pump the liquid from the reservoir, through the flexible tube, to the aperture in the bubble formation surface.

Yet another exemplary embodiment in accordance with the present disclosure is directed to a method of generating bubbles comprising providing an output assembly, which may comprise a bubble formation surface having an aperture defined therethrough, the bubble formation surface being operable to receive a liquid through the aperture, and first and second shutter flaps, wherein each shutter flap is operable to pivotably rotate from a first orientation to a second orientation. When the first and second shutter flaps are in their respective first orientations, an edge of the first shutter flap is adjacent to an edge of the second shutter flap, and the first and second shutter flaps are proximate to the bubble formation surface. When the first and second shutter flaps are in their respective second orientations, an air flow may be directed along a path through the central opening of the bubble formation surface and through the housing opening. The disclosed method may further include supplying the liquid through the aperture to the bubble formation surface, and forming a liquid film across a central opening defined in the bubble formation surface. The disclose method may also include providing the air flow through the central opening of the bubble formation surface when the first and second shutter flaps are in their respective second orientation.

DETAILED DESCRIPTION OF EMBODIMENTS

The disclosed figures illustrate various embodiments of a bubble generating apparatus with a shutter mechanism operable to form a bubble generating film across a shutter opening. The formation of the bubble film by the hand-held apparatus is symmetric while that of the prior art is asymmetric. However, the shutter mechanism can be used in devices other than hand-held devices and is not intended to be limited in its application.

Figure 1:
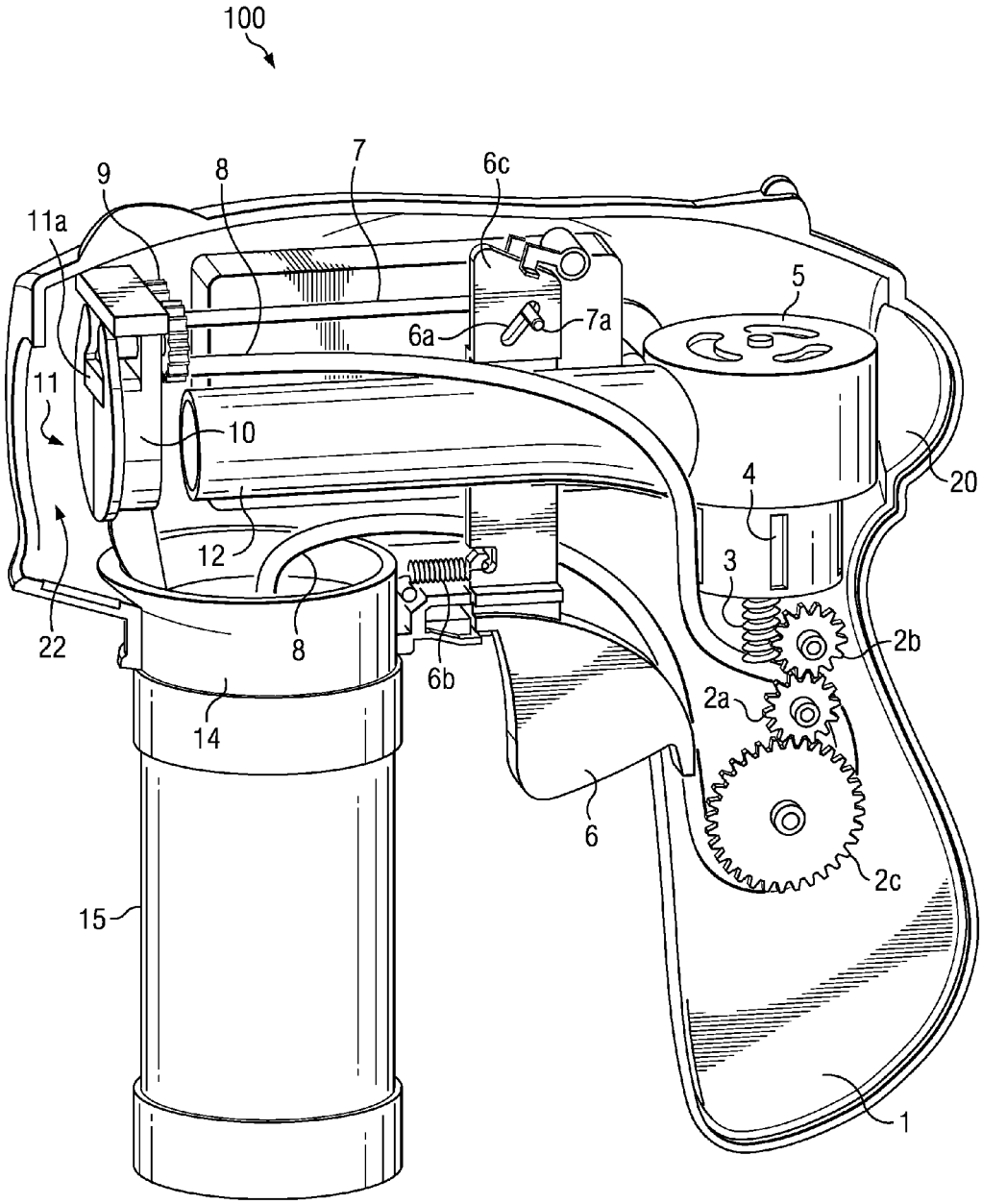
FIG. 1 is a partial cross-sectional view of a first embodiment of a bubble generating apparatus with a housing cut away to expose internal components of the apparatus, in accordance with the present disclosure.

FIG. 1 is a partial cross-sectional view of a first embodiment of a bubble generating apparatus 100 with a housing 1 cut away to expose internal components of the apparatus 100, in accordance with the present disclosure.

A reservoir 15 may be removably connected to the housing 1 by a reservoir connector 14. The reservoir 15 holds bubble generating liquid and may be configured in a variety of shapes. For example, the reservoir 15 may be a cylindrical container, as illustrated in FIG. 1. The reservoir connector 14 may include one or more of a wide variety of coupling mechanisms for attaching the reservoir 15 to the housing 1. In an exemplary embodiment, the reservoir connector 14 may include a threaded portion for receiving a corresponding threaded top portion of the reservoir 15. It is to be appreciated that other suitable coupling mechanisms may be used, including a mechanical latch or an interference fit.

Once the reservoir 15 is coupled with the housing 1 by the reservoir connector 14, the reservoir connector 14 may provide a cover over the reservoir 15 and cooperate with the reservoir 15 to provide a substantially enclosed space for retaining the bubble generating liquid within the reservoir 15. The reservoir connector 14 may include one or more small openings (not shown) defined therein that allow withdrawal of the bubble generating liquid from the reservoir 15 and then allow excess bubble generating liquid to drain back into the reservoir 15. In an embodiment, the small openings are formed discontinuously such that the drainage of the returning liquid does not interfere with the withdrawal of the liquid.

The reservoir connector 14 may be either integrally formed with or removably connected to a barrel section of the housing 1, as shown in FIG. 1. In addition to the barrel section, the housing 1 may have a handle section extending therefrom, forming a toy gun. In an alternative embodiment, the bubble generating apparatus 100 may be designed to be stationary and may not include a handle section. In addition, the housing 1 may form an internal chamber and include an end portion 20 and a housing opening 22 opposite the end portion 20. The housing opening 22 may expose a portion of the internal chamber to the environment. The end portion 20 may be an enclosed end portion.

A trigger 6 may extend from the housing handle and engage a spring 6*b*. The spring 6*b* is operable to return the trigger 6 to its resting position after the trigger 6 is squeezed and subsequently released. Inside the housing 1, the trigger 6 may be connected to or configured with an extension 6*c* that may have a cam opening 6*a*. The cam opening 6*a* may be configured to receive a cam extension 7*a* extending from a shutter arm 7. In one embodiment, the shutter arm 7 may be configured to run the length of the housing 1 from the end portion 20 to an output assembly 11 and engage a plurality of gears 9. The output assembly 11 may be connected to the housing 1. In an embodiment, as discussed in more details with respect to FIGS. 2 and 3, the output assembly 11 may be mounted within the internal chamber of the housing 1 and disposed proximate to the housing opening 22.

The internal chamber of the housing 1 may enclose a fan housing 5 and a motor housing 4 that surround a fan and an electric motor (not shown), respectively. Extending from the fan housing 5 through the internal chamber of the housing 1 is an air cylinder 12 which may terminate adjacent to a bubble assembly support 10. The fan may be configured to blow air through the air cylinder 12 and a central opening of the output assembly 11 in order to blow a bubble through the housing opening 22.

The motor may be configured to power a pumping mechanism to draw bubble generating liquid from the reservoir 15. In an embodiment, the pumping mechanism may include a spur gear 3 which turns a plurality of gears 2*a*, 2*b*, and 2*c*, causing the bubble generating liquid to be drawn through an internal tubing 8. The tubing 8 may communicate the bubble generating liquid from the reservoir 15 through the internal chamber of the housing 1 to a member 11*a* of the output assembly 11. At least one of the gears 2*a*, 2*b*, or 2*c* may be configured with a shoulder to intermittingly pinch the tubing 8 in order to restrict the flow of the bubble generating liquid within the tubing 8 in much the same way that an IV pumps fluids.

Figure 2:
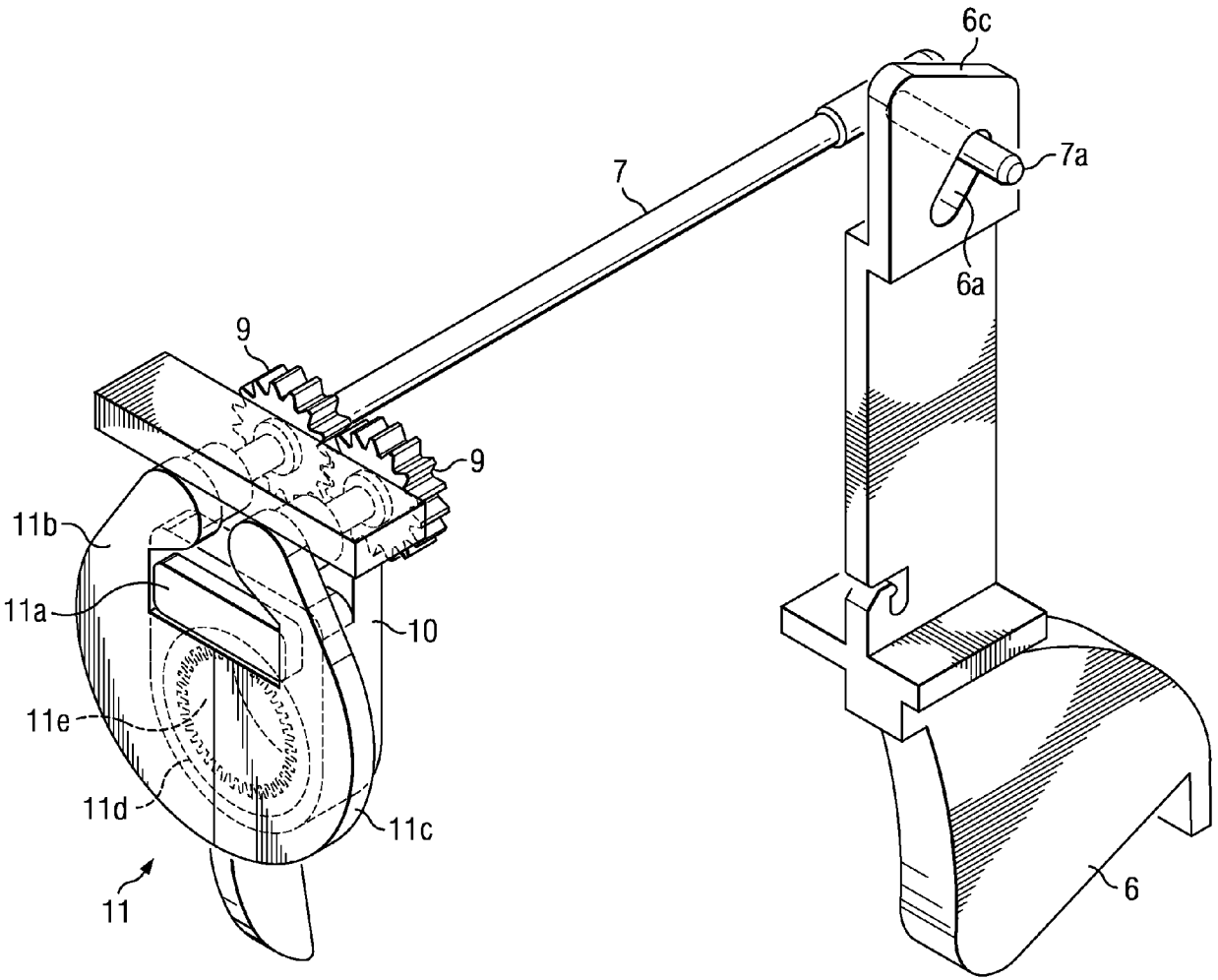
FIG. 2 is a perspective view of an output assembly mounted within the bubble generating apparatus shown in FIG. 1 in a first orientation, in accordance with the present disclosure.
Figure 3:
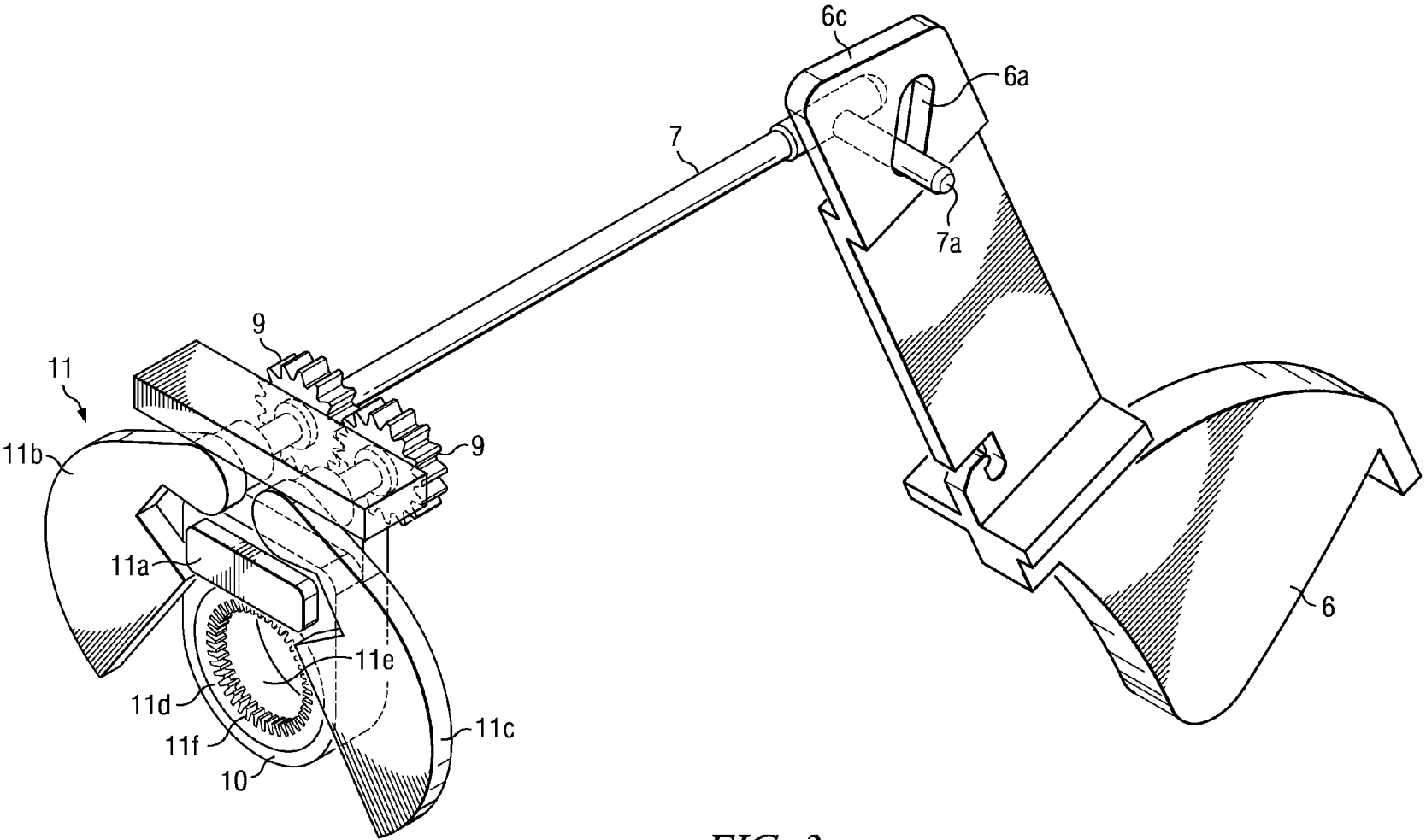
FIG. 3 is a perspective view of the output assembly shown in FIG. 2 in a second orientation, in accordance with the present disclosure.
Figure 4:
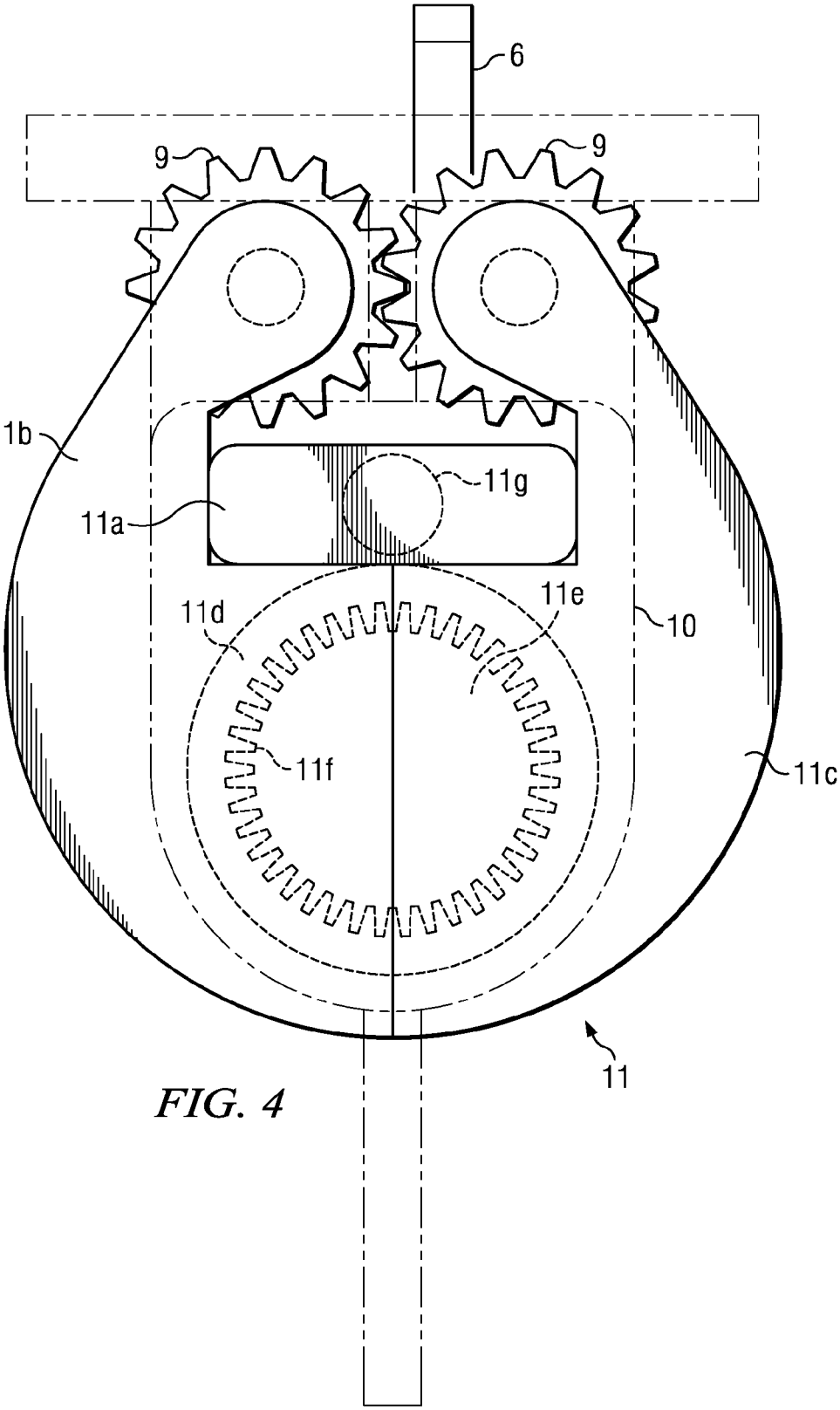
FIG. 4 is a front view of the output assembly shown in FIGS. 2-3, in accordance with the present disclosure.

FIG. 2 is a perspective view of the output assembly 11 shown in FIG. 1 in a first orientation, in accordance with the present disclosure. FIG. 3 is a perspective view of the output assembly 11 shown in FIG. 2 in a second orientation, in accordance with the present disclosure. FIG. 4 is a front view of the output assembly 11 shown in FIGS. 2 and 3 in the first orientation, in accordance with the present disclosure.

In an embodiment, the bubble assembly support 10 may provide structural support for various components of the output assembly 11, and a portion of the output assembly 11 may be removably coupled to or integrally formed with the bubble assembly support 10. The output assembly 11 may include a bubble formation surface 11*d* and a central opening 11*e* defined therethrough. The bubble formation surface 11*d* may comprise a plurality of ridges 11*f* extending therefrom and proximate to first and second shutter flaps 11*b* and 11*c*. In an embodiment, the ridges 11*f* may be disposed circumferentially about the bubble formation surface 11*d*. Advantageously, the ridges 11*f* on the bubble formation surface 11*d* may help to continuously provide and supplement the necessary bubble generating liquid that is required to form bubbles. In particular, the ridges 11*f* may be especially advantageous when the bubble generating apparatus 100 is pointed in a particular direction. For example, provision of bubble generating liquid via gravity may be negligible when the barrel of the bubble generating apparatus 100 is pointed towards the sky, but the ridges 11*f* may trap, hold, and provide a small amount of bubble generating liquid sufficient to create a liquid film across the central opening 11*e* for bubble forming.

In an embodiment, the output assembly 11 may further include the first and second shutter flaps 11*b* and 11*c* operable to pivotably rotate from a first, closed orientation to a second, open orientation when the trigger 6 is squeezed. In the first, closed orientation, an edge of the first shutter flap 11*b* is adjacent to an edge of the second shutter flap 11*c*, and the first and second shutter flaps are proximate to the bubble formation surface 11*d*. In the second, open orientation, the first and second shutter flaps 11*b* and 11*c* may define a shutter opening that exposes the central opening 11*e* of the bubble formation surface 11*d* to the environment. As such, an air flow may be directed along a path through the central opening 11*e* of the bubble formation surface 11*d* and through the housing opening 22. In an embodiment, the first and second shutter flaps 11*b* and 11*c* may each abut a portion of the bubble formation surface 11*d* when the first and second shutter flaps 11*b* and 11*c* are in their respective first orientations. In another embodiment, the first and second shutter flaps 11*b* and 11*c* may be spaced from the bubble formation surface 11*d* when the first and second shutter flaps 11*b* and 11*c* are in their respective first orientations.

The trigger 6 may be configured to effect a rotation of the shutter flaps 11*b* and 11*c* via a variety of mechanical coupling. In an exemplary embodiment, when the trigger 6 is squeezed, the extension 6*c* and the cam opening 6*a* may pivotably rotate, causing the cam extension 7*a* to move from a first position to a second position, which in turn, rotates the shutter arm 7. When the shutter arm 7 rotates, the plurality of gears 9 are turned, causing the pair of shutter flaps 11*b* and 11*c* to rotate from the first orientations, as shown in FIG. 2, to the second orientation, as shown in FIG. 3. Each time that the trigger 6 is pulled, the pair of shutter flaps 11*b* and 11*c* may pivotably rotate from their first orientations to their second orientations, and each time the trigger 6 is released, the spring (internal, not shown) may pivotably rotate the pair of shutter flaps 11*b* and 11*c* back to their respective first orientations. It is to be appreciated that in addition to the illustrated embodiment, the trigger 6 and the shutter flaps 11*b* and 11*c* may be coupled with various combinations of gear trains and connectors.

To generate bubbles, the bubble formation surface 11*d* may include an aperture 11*g*, as shown in FIG. 4, defined therethrough for receiving a bubble generating liquid via tubing (not shown). The output assembly 11 may further include a member 11*a* connected to the bubble formation surface 11*d* and disposed proximate to the aperture 11*g*. The member 11*a* may be operable to direct the liquid received from the aperture 11*g* towards the ridged portion of the bubble formation surface 11*d*. For example, the bubble generating liquid may be dispensed through the aperture 11*g*, and its path may be obstructed by the member 11*a*, causing the liquid to deflect off the member 11*a* and flow downward via gravity towards the bubble formation surface 11*d*. In an embodiment, the gravity flow of liquid may allow for a constant and even supply of liquid over the bubble formation surface 11*d* rather than an uncontrollable and uneven supply. Such a constant supply of liquid, in turn, may allow for maximizing the uniformity of the film and the chance of the film resulting in bubbles.

Provided with bubble generating liquid on the bubble formation surface 11*d*, a liquid film operable to provide bubbles may be formed by the shutter flaps 11*b* and 11*c*. As the pair of shutter flaps 11*b* and 11*c* pivotably rotate from their first orientations to their second orientations, the shutter flaps 11*b* and 11*c* may spread a liquid film across the central opening 11*e* in a symmetric manner to maximize the uniformity of the film and the chance of the film resulting in bubbles. When air is blown through the air cylinder (not shown), a bubble may be formed at the central opening 11*e*. In another embodiment, with the shutter flaps 11*b* and 11*c* in the first, closed orientation, gravity may be operable to pull a surplus amount of liquid from the top of the bubble formation surface 11*d* around perimeter of the bubble formation surface 11*d* and across the shutter flaps 11*b* and 11*c* on both sides of the flaps 11*b* and 11*c*. As such, a film may be formed over the central opening 11*e* with the shutter flaps 11*b* and 11*c* in the first, closed orientation. As the shutter flaps 11*b* and 11*c* rotate to the second, open orientation, bubbles may be formed when air flows through the film stretching across the shutter flaps 11*b* and 11*c* and over the central opening 11*e*, and once the bubbles begin to form, the supply of liquid from the top of the underlying bubble formation surface 11*d* may allow the film to be continually formed over the central opening 11*e* and allow for continuous bubble formation. Again, a symmetric operation of the shutter flaps 11*b* and 11*c* may improve the uniformity of the film and the chance of the film resulting in bubbles.

Figure 5:
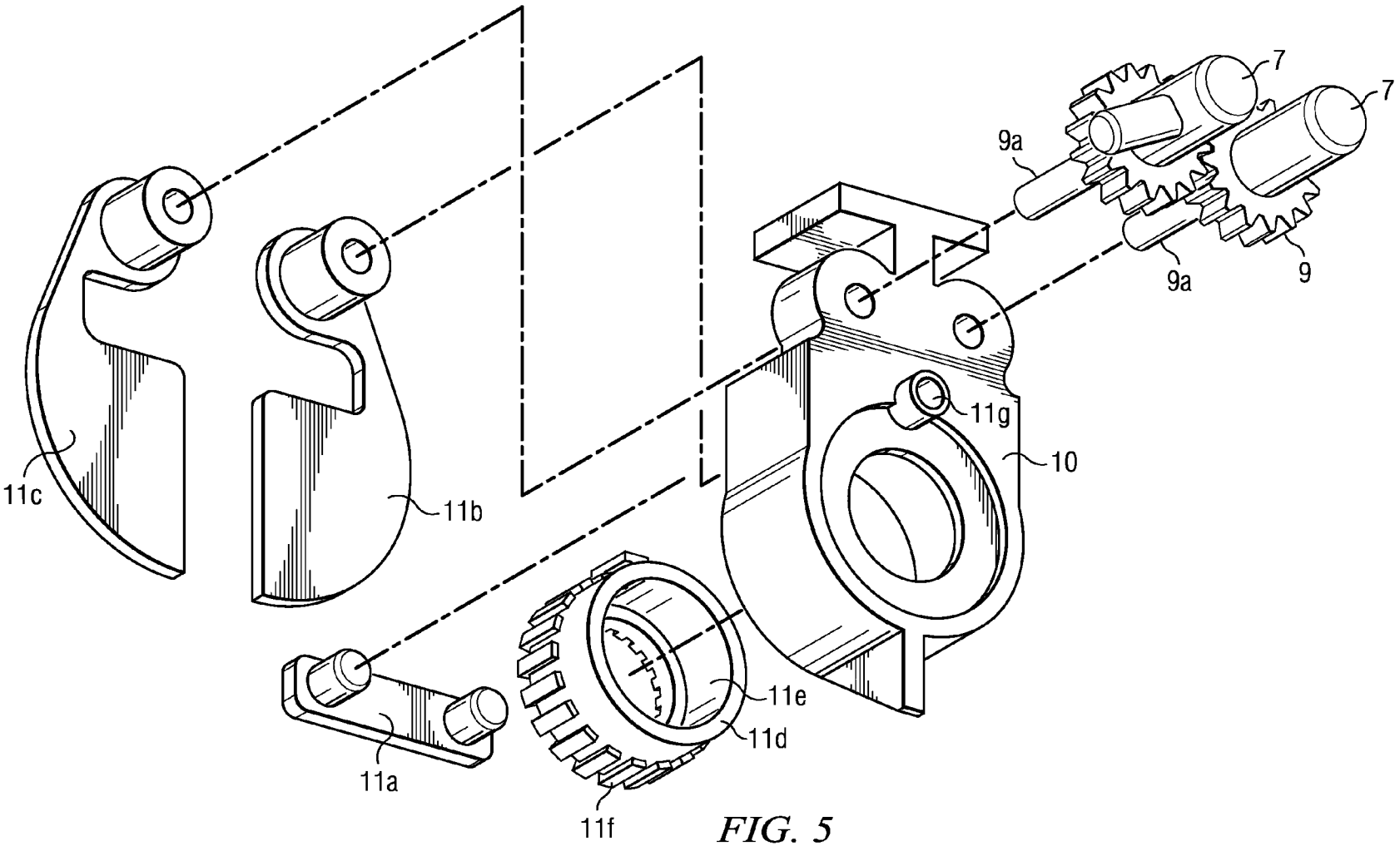
FIG. 5 is an exploded view of the output assembly shown in FIGS. 2-4, in accordance with the present disclosure.

FIG. 5 is a rear exploded view of a portion of the bubble generating device 100. The illustrated aperture 11*g* is operable to be connected with the tubing 8 (as shown in FIG. 1) and provide a conduit for liquid to flow towards the member 11*a*. The tubing (not shown) may be configured to be connected onto an end of the aperture 11*g* as shown in FIG. 5, in order to supply the bubble generating liquid to the bubble formation surface 11*d*. The member 11*a* may be configured to either partially or fully cover (shown) the path of the bubble generating liquid that may be received through the aperture 11*g*. By either partially or fully covering the aperture 11*g*, the member 11*a* may redirect the bubble generating liquid toward the bubble formation surface 11*d* in a gravity flow.

The bubble generating liquid may be pumped by a motor (not shown) via the tubing (not shown) through the aperture 11*g* to the member 11*a*. When the liquid comes into contact with the member 11*a*, it may fall by gravity to the bubble formation surface 11*d* behind the closed pair of shutter flaps 11*b* and 11*c* when they are in their respective first orientations. When the pair of shutter flaps 11*b* and 11*c* are pivotably rotated to their second orientations by means of the plurality of gears 9, as described above, the opening motion may spread an even, consistent film of bubble generating liquid across the central opening 11*e*.

Figure 6:
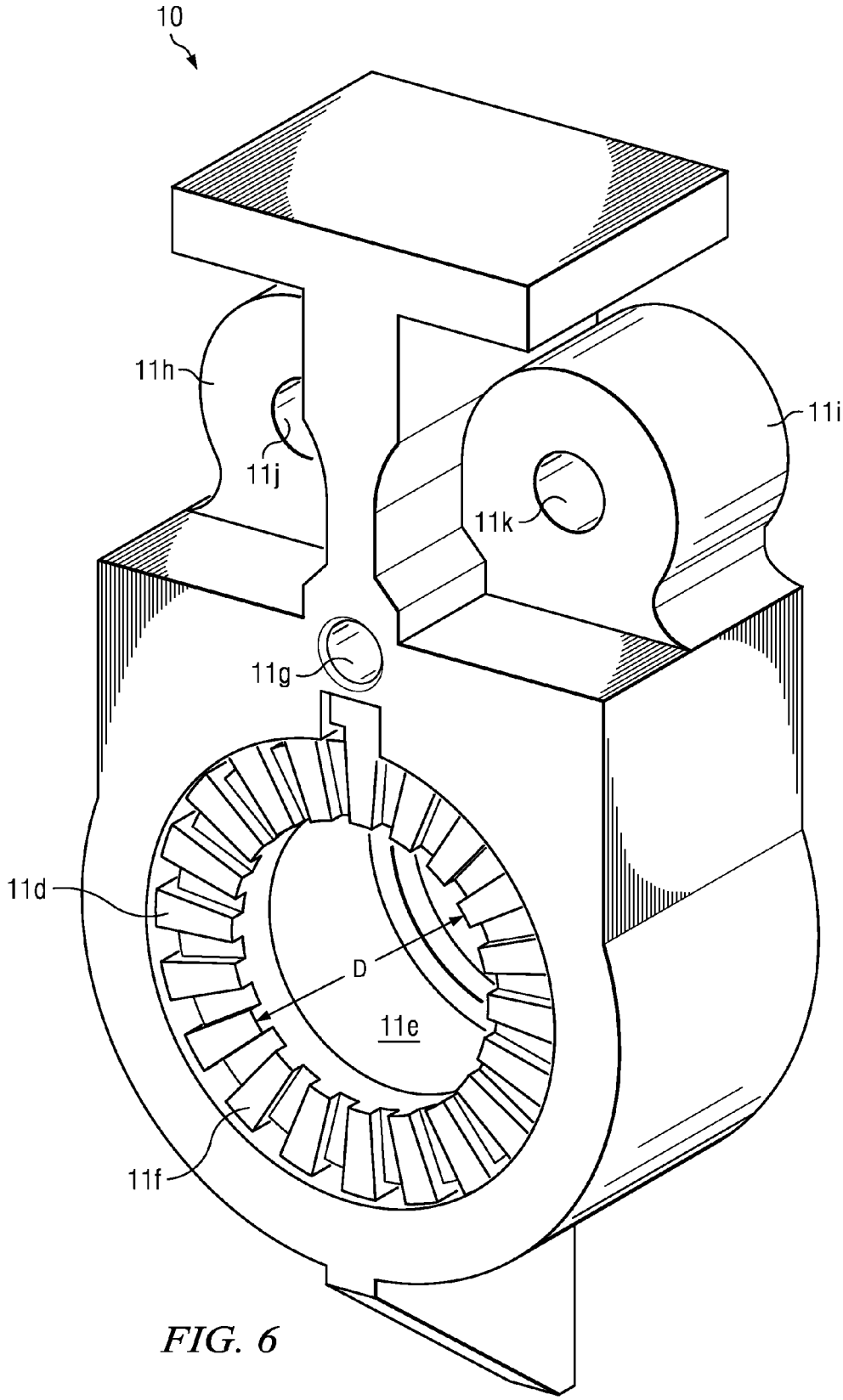
FIG. 6 is a perspective view of a bubble assembly support and a bubble formation surface shown in FIGS. 2-5, in accordance with the present disclosure.

FIG. 6 is a partial, perspective view of a portion of the output assembly received in the bubble assembly support 10. In an embodiment, a portion of the output assembly 11 is received in a first portion of the bubble assembly support 10, and the first and second shutter flaps 11*b* and 11*c* of the output assembly 11 are connected to a second portion of the bubble assembly support 10. In an embodiment, the bubble assembly support 10 and the output assembly 11 may cooperate to form a two part circular structure comprising an outer structure of the bubble assembly support 10 and a stepped down inner structure of the bubble formation surface 11*d*, as shown in FIG. 6. The bubble assembly support 10 also can include a T-shaped structure for mounting within the internal chamber of the housing 1.

The central opening 11*e* of the output assembly 11, as shown in FIG. 6, may have a diameter, D. In an exemplary embodiment, the diameter D may be 0.75 cm, although the diameter D may be enlarged to increase the size of the bubbles produced or may be contracted to decrease the size of the bubbles produced. The bubble assembly support 10 may also be configured with a pair of shoulders 11*h* and 11*i*, each with a central aperture 11*j* and 11*k*, respectively, that may be configured to receive a pair of extensions 9*a* extending from the plurality of gears 9 on the shutter arms 7, as shown in FIG. 5.

Figure 7:
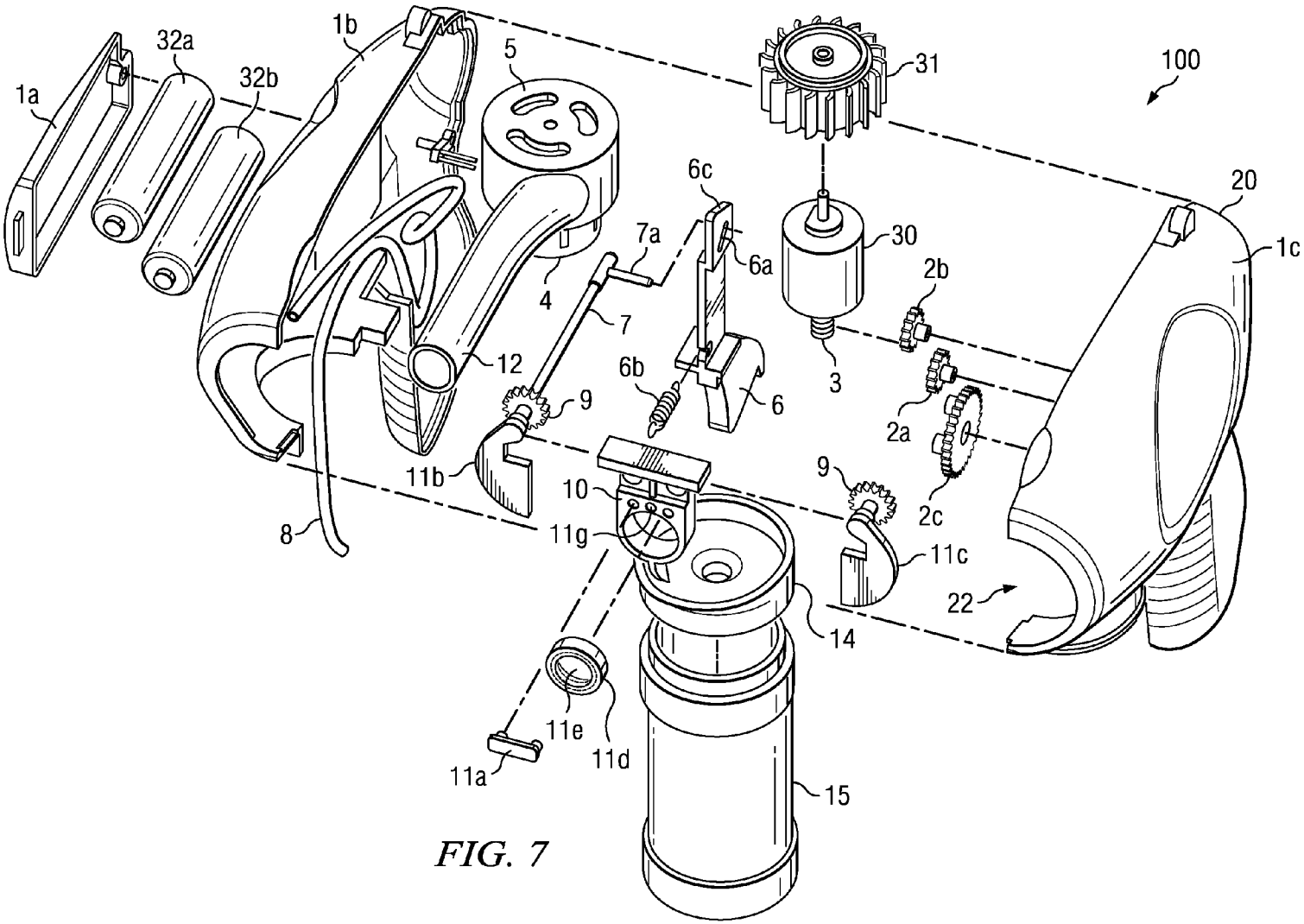
FIG. 7 is an exploded view of the bubble generating apparatus shown in FIG. 1, in accordance with the present disclosure.

FIG. 7 is an exploded view of the bubble generating apparatus 100 of FIGS. 1-6. In addition to the elements already disclosed, FIG. 7 also illustrates a motor 30 that is received in the motor housing 4 and a fan 31 driven by the motor 30 and received into the fan housing 5. The motor 30 may be powered by batteries 32*a* and 32*b*, which in some exemplary embodiments may be AA or AAA batteries. The batteries 32*a* and 32*b* may be received into the housing 1, which may include a right housing 1*b* and a left housing 1*c* and be covered by a housing battery cover 1*a*.

Referring to FIGS. 1-7, in operation, when the trigger 6 is squeezed, the motor 30 may be activated, turning the spur gear 3 and the fan 31. The spur gear 3 may be configured to turn the plurality of gears 2*a*, 2*b*, and 2*c*. As such, the motor 30 may be configured to communicate the bubble generating liquid from the reservoir 15 through the tubing 8 and the aperture 11*g* to the member 11*a*. When the bubble generating liquid reaches the member 11*a*, the liquid may fall by gravity and spread across the bubble formation surface 11*d*. When the pair of shutters 11*b* and 11*c* are pivotably rotated from their first orientations to their second orientations, the liquid may be spread symmetrically across the central opening 11*e* of the bubble formation surface 11*d*, advantageously creating an even film across the central opening 11*e*.

At the same time, the motor 30 may be configured to rotate the fan 31 in order to create air flow through the air cylinder 12. A continuous stream of air may be blown through the air cylinder 12 from the fan 31 to the output assembly 11. When the trigger 6 is squeezed, the pair of shutter flaps 11*b* and 11*c* may be pivotably rotated to their second orientations, exposing the central opening 11*e* to the housing opening 22. When the central opening 11*e* and the housing opening 22 are both exposed to the environment, the air flow created by the motor 30 blows through the liquid film spread across the central opening 11*e* and generates a bubble at the housing opening 22.

Figure 8:
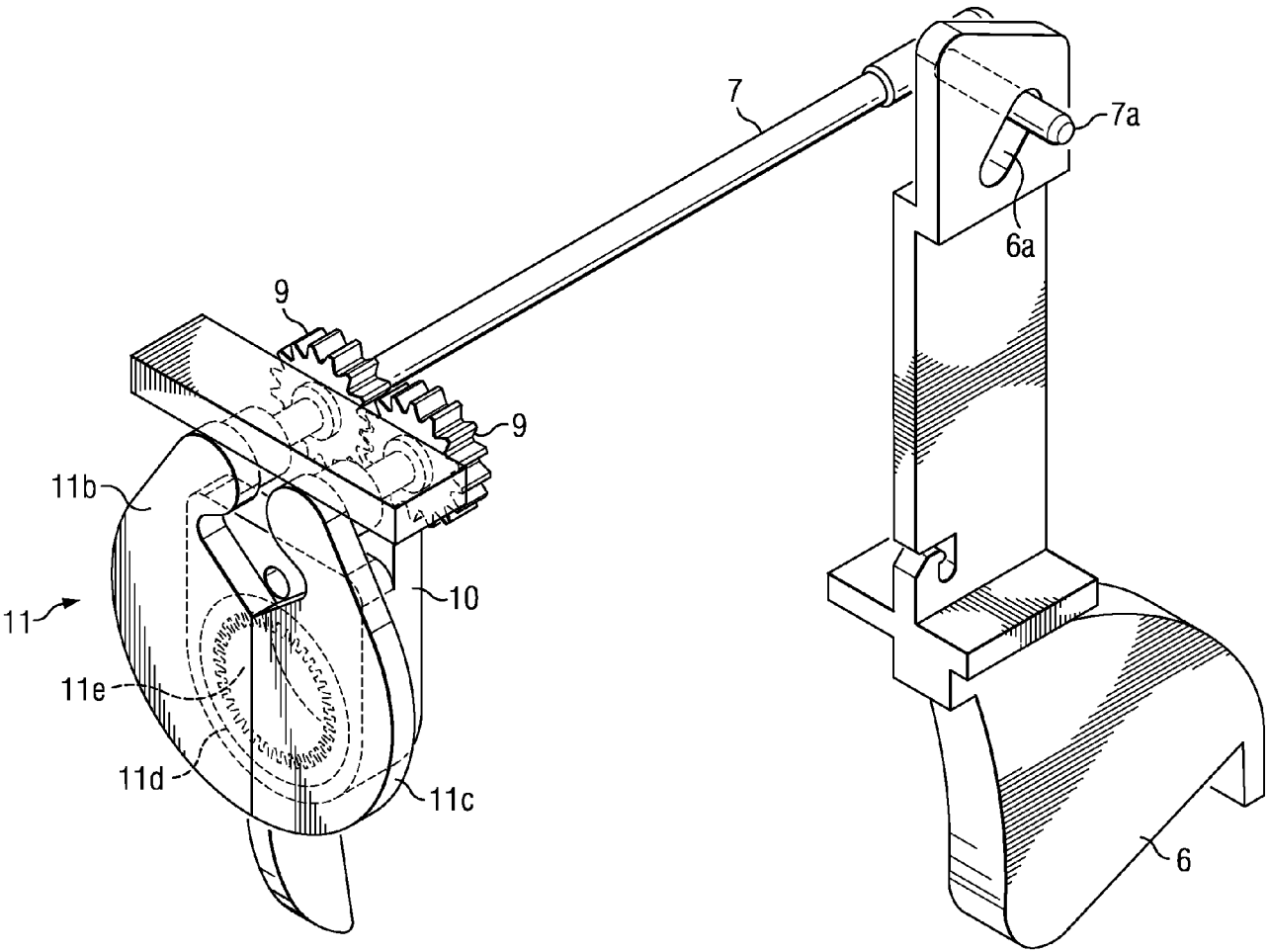
FIG. 8 is perspective view of an alternative embodiment of the output assembly of FIG. 1 in a first orientation, in accordance with the present disclosure.
Figure 9:
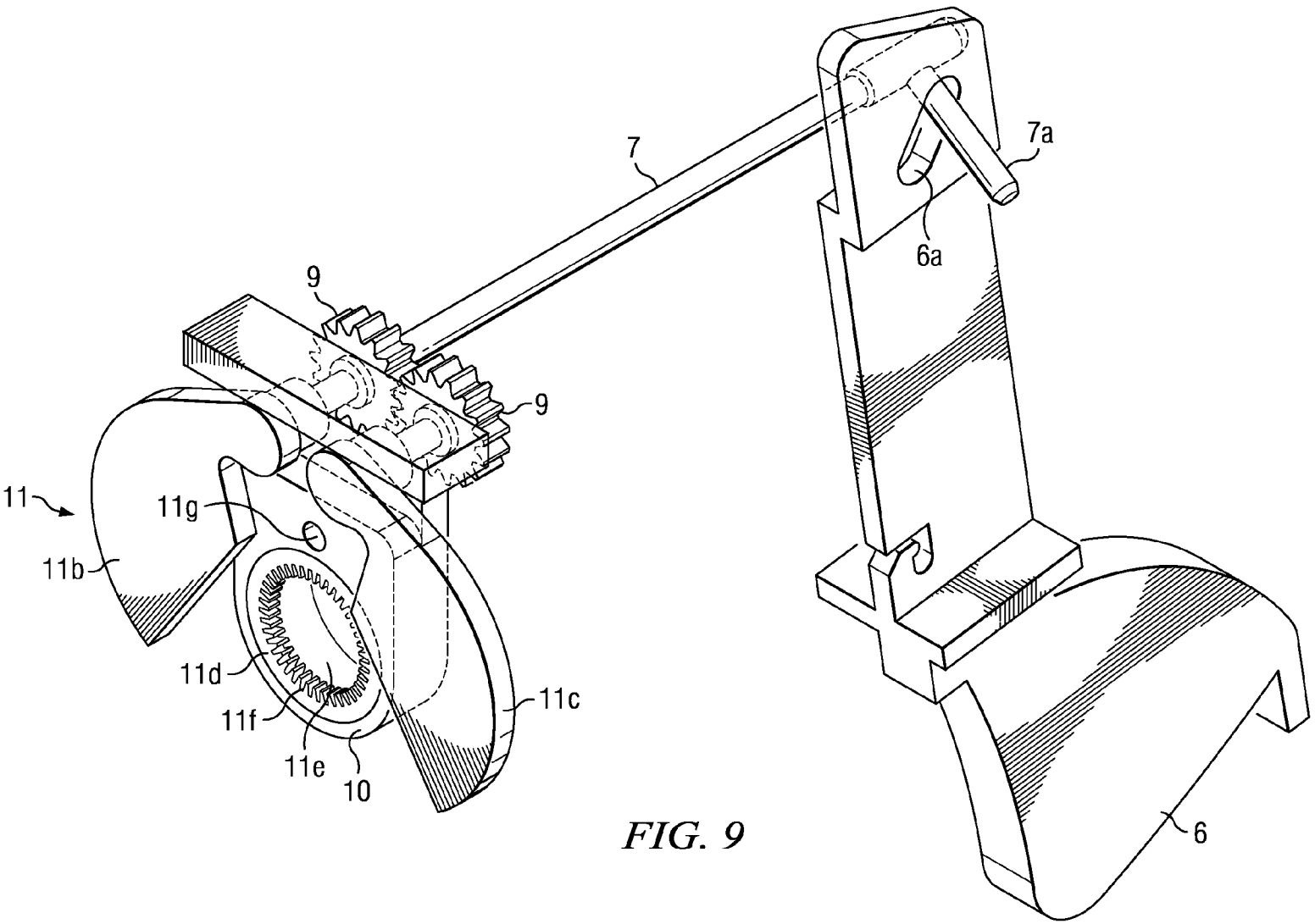
FIG. 9 is a perspective view of the alternative embodiment of the output assembly shown in FIG. 8 in a second orientation, in accordance with the present disclosure.

FIG. 8 is a perspective view of an embodiment of the output assembly 11 in a first orientation, in accordance with the present disclosure. FIG. 9 is a perspective view of the output assembly 11 shown in FIG. 8 in a second orientation, in accordance with the present disclosure.

In an embodiment, the output assembly 11 does not include the member 11*a* seen in FIGS. 1-7. Without the member 11*a*, the bubble generating liquid is communicated via the tubing 8 (not shown) through the aperture 11*g*, and onto the bubble formation surface 11*d* behind the pair of shutter flaps 11*b* and 11*c* when the pair of shutter flaps 11*b* and 11*c* are in their first orientations. When the pair of shutter flaps 11*b* and 11*c* are pivotably rotated to their second orientations, the bubble generating liquid may spread evenly across the bubble formation surface 11*d*, creating a film across the central opening 11*e*. When the central opening 11*e* is exposed to the environment, the air cylinder 12 (not shown) may be configured to blow an air flow through the film across the central opening 11*e*, creating a bubble.

Figure 10:
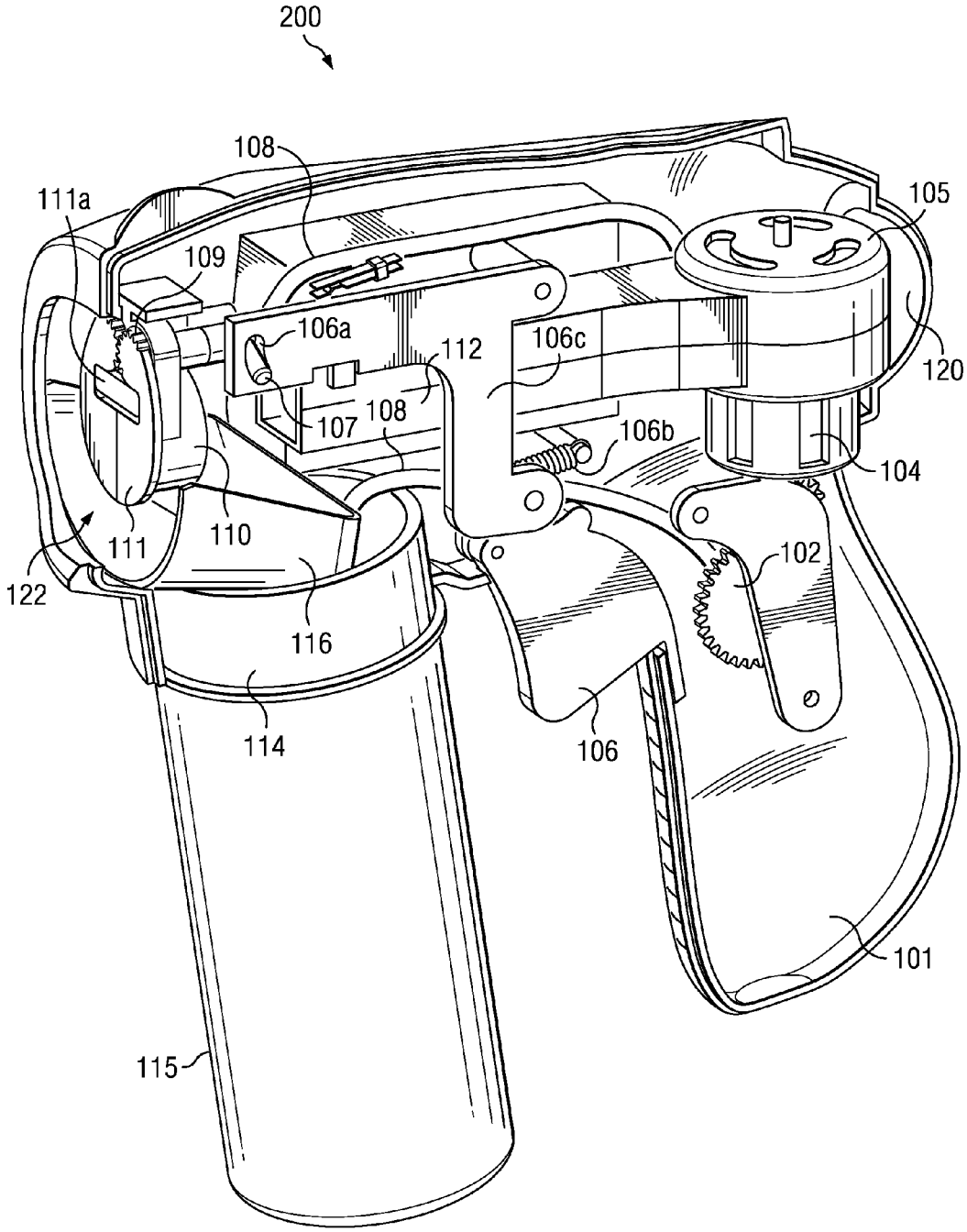
FIG. 10 is a partial cross-sectional view of a second embodiment of the bubble generating apparatus with the housing cut away to expose internal components of the apparatus, in accordance with the present disclosure.

FIG. 10 is a partial cross-sectional view of a second embodiment of a bubble generating apparatus 200 with a housing 101 cut away to expose internal components of the apparatus 200.

A reservoir 115 may be removably connected to the housing 101 by a reservoir connector 114. The reservoir 115 holds bubble generating liquid and may be configured in a variety of shapes. For example, the reservoir 115 may be a cylindrical container, as illustrated in FIG. 1. The reservoir connector 114 may include one or more of a wide variety of coupling mechanisms for attaching the reservoir 115 to the housing 101. In an exemplary embodiment, the reservoir connector 114 may include a threaded portion for receiving a corresponding threaded top portion of the reservoir 115. It is to be appreciated that other suitable coupling mechanisms may be used, including a mechanical latch or an interference fit.

Once the reservoir 115 is coupled with the housing 101 by the reservoir connector 114, the reservoir connector 114 may provide a cover over the reservoir 115 and cooperate with the reservoir 115 to provide a substantially enclosed space for retaining the bubble generating liquid within the reservoir 115. The reservoir connector 114 may include one or more small openings (not shown) defined therein that allow withdrawal of the bubble generating liquid from the reservoir 115 and then allow excess bubble generating liquid to drain back into the reservoir 115. In an embodiment, the small openings are formed discontinuously such that the drainage of the returning liquid does not interfere with the withdrawal of the liquid.

As shown in FIG. 10, the reservoir connector 114 may be either integrally formed with or removably connected to a barrel section of the housing 101. In addition to the barrel section, the housing 101 may have a handle section extending therefrom. In an alternative embodiment, the bubble generating apparatus 200 may be designed to be stationary and may not include a handle section. In addition, the housing 101 may form an internal chamber and include an end portion 120 and a housing opening 122 opposite the end portion 120. The housing opening 122 may expose a portion of the internal chamber to the environment. The end portion 120 may be an enclosed end portion in an embodiment.

A trigger 106 may extend from the housing 101 handle and engage a spring 106*b*. The spring 106*b* is operable to return the trigger 106 to its resting position after the trigger 106 is squeezed and subsequently released. Inside the housing 101, the trigger 106 may be connected to or configured with an extension 106*c* that may have a cam opening 106*a*. The cam opening 106*a* may be configured to receive a cam extension 107 extending from an output assembly 111. The output assembly 111 engages a plurality of gears 109 defined in a plurality of shutter flaps 111*b* and 111*c* operable to interact with the cam extension 107. The output assembly 111 may be connected to the housing 101. In an embodiment as discussed in more details with respect to FIGS. 11 and 12, the output assembly 111 may be mounted within the internal chamber of the housing 101 and disposed proximate to the housing opening 122. The gears 109 defined in the plurality of shutter flaps 111*b* and 111*c* may be located in front of the output assembly 111 and proximate to the housing opening 122.

As shown in FIG. 10, the extension 106*c* may extend substantially from the trigger 106 to the output assembly 111, with the cam extension 107 located proximate to the output assembly 111. Alternatively, and as shown in FIG. 1, a shutter arm may be configured to run the length of the housing from the end portion of the housing to the output assembly, with the cam extension located away from the output assembly.

The internal chamber of the housing 101 may enclose a fan housing 105 and motor housing 104 which surround a fan and an electric motor (not shown), respectively. Extending from the fan housing 105 through the internal chamber of the housing 101 is an air cylinder 112 which terminates adjacent to a bubble assembly support 110. The fan may be configured to blow air through the air cylinder 112 and the output assembly 111 in order to blow a bubble out of the housing opening 122. The motor may be configured to rotate a spur gear (not shown) which turns a plurality of gears 102, causing the bubble generating liquid to flow within an internal tubing 108 from the reservoir 115 through the internal chamber of the housing 101 to a member 111*a* in the output assembly 111. At least one of the gears 102 may be configured to intermittingly pinch the tubing 108 in order to restrict the flow of the bubble generating liquid within the tubing 108 in much the same way that an IV pumps fluids.

Figure 11:
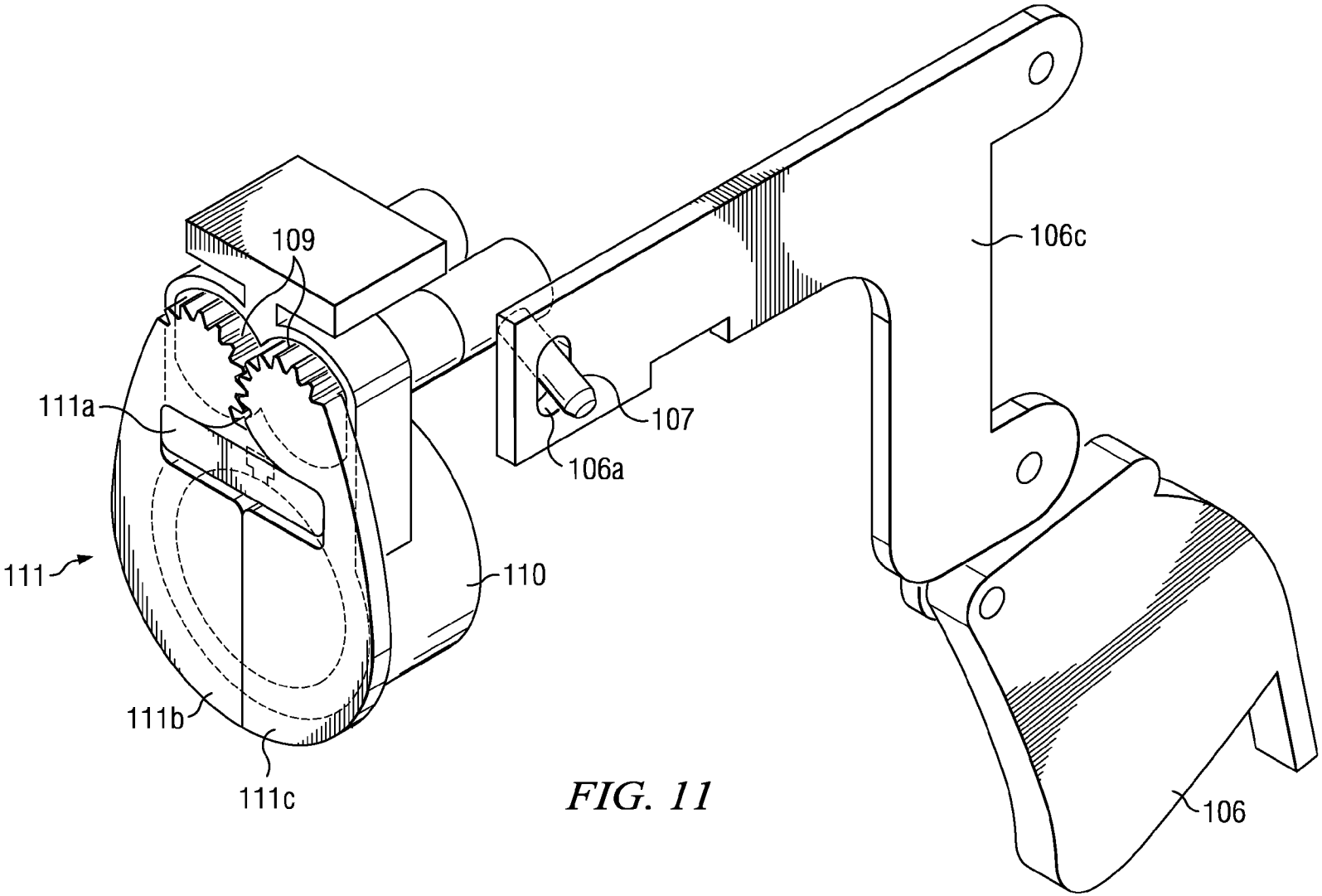
FIG. 11 is a perspective view of an output assembly mounted within the bubble generating apparatus shown in FIG. 10 in a first orientation, in accordance with the present disclosure.
Figure 12:
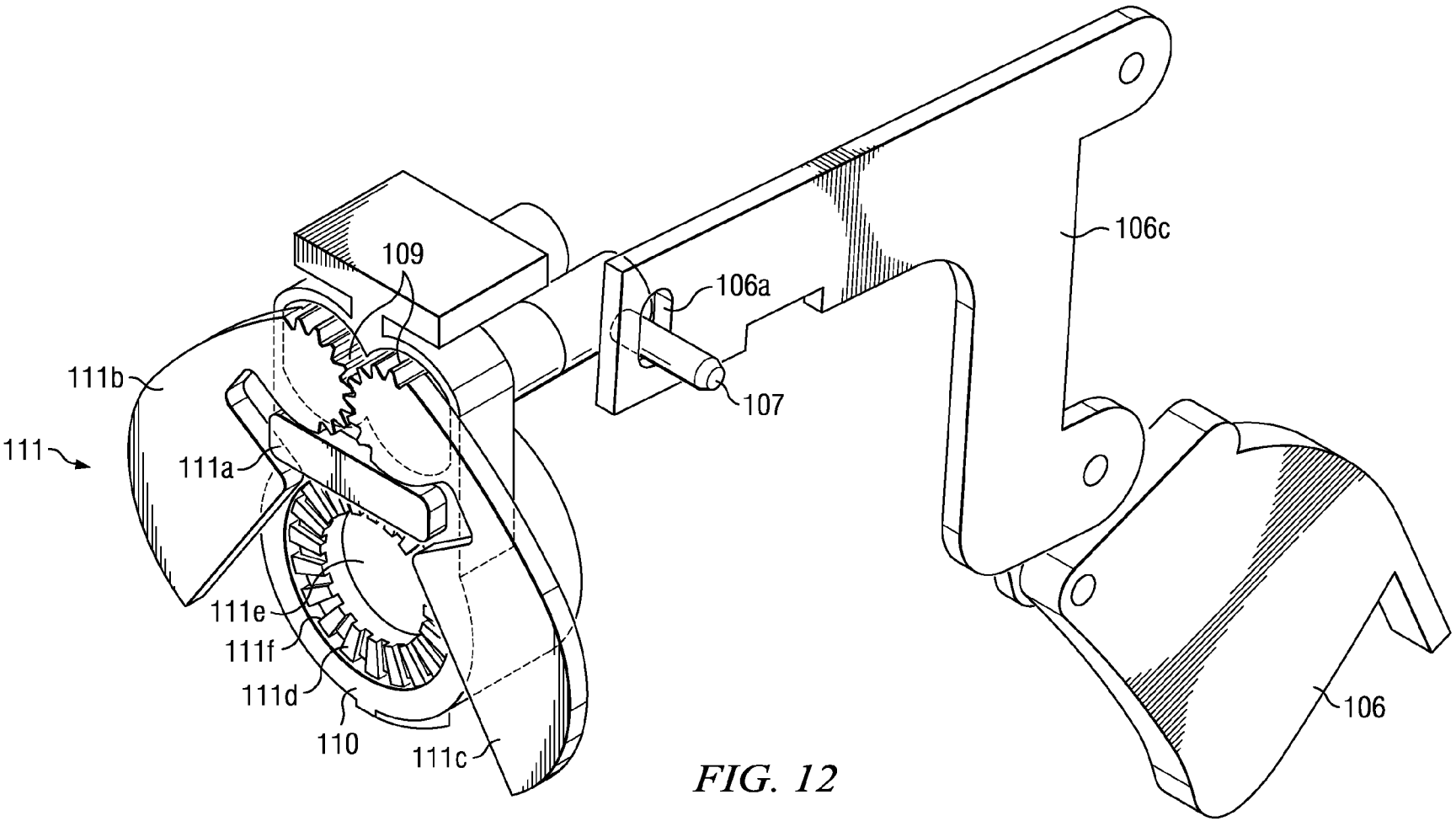
FIG. 12 is a perspective view of the output assembly shown in FIG. 11 in a second orientation, in accordance with the present disclosure.

FIG. 11 is a perspective view of a output assembly 111 mounted within the bubble generating apparatus 111 shown in FIG. 10 in a first orientation, in accordance with the present disclosure. FIG. 12 is a perspective view of the output assembly 111 shown in FIG. 11 in a second orientation, in accordance with the present disclosure.

The output assembly 111 may include the pair of shutter flaps 111*b* and 111*c* each comprising a plurality of gears 109 operable to pivotably rotate with each other in opposite directions from a first orientation to a second orientation when the trigger 106 is squeezed. In the first, closed orientation, an edge of the first shutter flap 111*b* is adjacent to an edge of the second shutter flap 111*c*, and the first and second shutter flaps 111*b*, 111*c* are proximate to a bubble formation surface 111*d*. In the second, open orientation, the first and second shutter flaps 111*b* and 111*c* may define a shutter opening that exposes the bubble formation surface 111*d* to the environment. In an embodiment, when the trigger 106 is squeezed, the extension 106*c* and the cam opening 106*a* may rotate, causing the cam extension 107 to move from a first position to a second position, rotating the plurality of gears 109.

Unlike the embodiments disclosed in FIGS. 1-9, the embodiments disclosed in FIGS. 10-12 do not include an extended shutter arm. Instead, the extension 106*c* extends from the trigger 106 to the bubble assembly support 110 proximate the housing opening 122, and rotates the cam extension 107, which in turn rotate the plurality of gears 109. Each time that the trigger 106 is pulled resulting in the plurality of gears 109 being turned, the pair of shutter flaps 111*b* and 111*c* pivotably rotate from their first orientations, as shown in FIG. 11, to their second orientations, as shown in FIG. 12. Each time the trigger 106 is released, the spring 106*b* (not shown) pivotably rotates the pair of shutter flaps 111*b* and 111*c* back to their first orientations.

The output assembly 111 may comprise the bubble formation surface 111*d* with a central opening 111*e* defined therethrough. The bubble formation surface 111*d* may comprise a plurality of ridges 111*f* extending therefrom. Similar to the advantages discussed with FIGS. 2 and 3, the ridges 111*f* on the bubble formation surface 111*d* may help to continuously provide sufficient bubble generating liquid to form bubbles. In particular, the ridges 111*f* may be especially advantageous when the bubble generating apparatus 200 is pointed vertically because the ridges 111*f* can trap, hold, and provide a small stream of bubble generating liquid to create a film across the shutter opening 111*e* necessary to form a bubble.

To generate bubbles, the bubble formation surface 111*d* may include an aperture (not shown) defined therethrough for receiving a bubble generating liquid via tubing 108. The output assembly 111 may further include a member 111*a* connected to the bubble formation surface 111*d* and disposed proximate to the aperture. The member 111*a* may be operable to direct the liquid received from the aperture towards the ridged portion of the bubble formation surface 111*d*. For example, the bubble generating liquid may be dispensed through the aperture, and its path may be obstructed by the member 111*a*, causing the liquid to deflect off the member 111*a* and flow downward via gravity towards the bubble formation surface 111*d*. In an embodiment, the gravity flow of liquid may allow for a constant and even supply of liquid over the bubble formation surface 111*d* rather than an uncontrollable and uneven supply. Such a constant supply of liquid, in turn, may allow for maximizing the uniformity of the film and the chance of the film resulting in bubbles Provided with bubble generating liquid on the bubble formation surface 111*d*, a liquid film operable to provide bubbles may be formed by the shutter flaps 111*b* and 111*c*. As the pair of shutter flaps 111*b* and 111*c* pivotably rotate from their first orientations to their second orientations, the shutter flaps 111*b* and 111*c* may spread a liquid film across the central opening 111*e* in a symmetric manner to maximize the uniformity of the film and the chance of the film resulting in bubbles. An air flow may be directed along a path through the central opening 111*e* of the bubble formation surface 111*d* and through the housing opening 122. When air is blown through the air cylinder (not shown), a bubble may be formed at the central opening 111*e*. In another embodiment, with the shutter flaps 111*b* and 111*c* in the first, closed orientation, gravity may be operable to pull a surplus amount of liquid from the top of the bubble formation surface 111*d* around perimeter of the bubble formation surface 111*d* and across the shutter flaps 111*b* and 111*c* on both sides of the flaps 111*b* and 111*c*. As such, a film may be formed over the central opening 111*e* with the shutter flaps 111*b* and 111*c* in the first, closed orientation. As the shutter flaps 111*b* and 111*c* rotate to the second, open orientation, bubbles may be formed when air flows through the film stretching across the shutter flaps 111*b* and 111*c* and over the central opening 111*e*, and once the bubbles begin to form, the supply of liquid from the top of the underlying bubble formation surface 111*d* may allow the film to be continually maintained over the central opening 111*e* and allow for continuous bubble formation. Again, a symmetric operation of the shutter flaps 111*b* and 111*c* may improve the uniformity of the film and the chance of the film resulting in bubbles.

Figure 13:
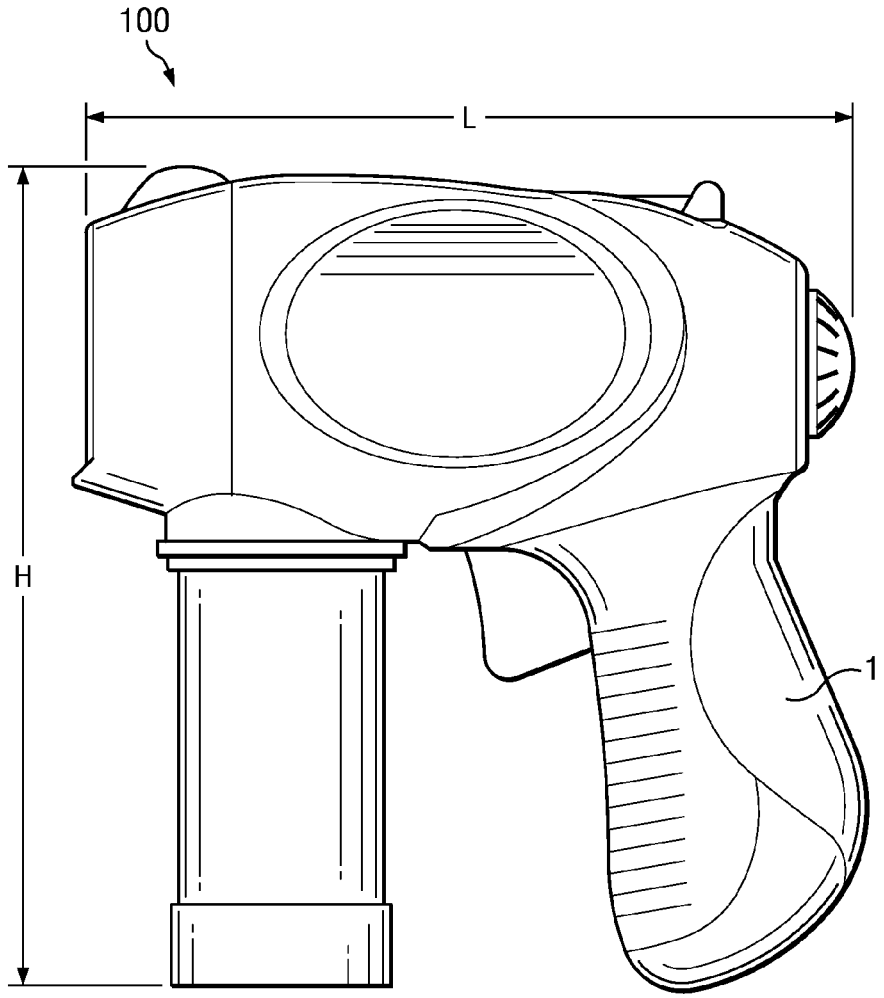
FIG. 13 is a side view of the bubble generating apparatus of FIG. 1, in accordance with the present disclosure.
Figure 14:
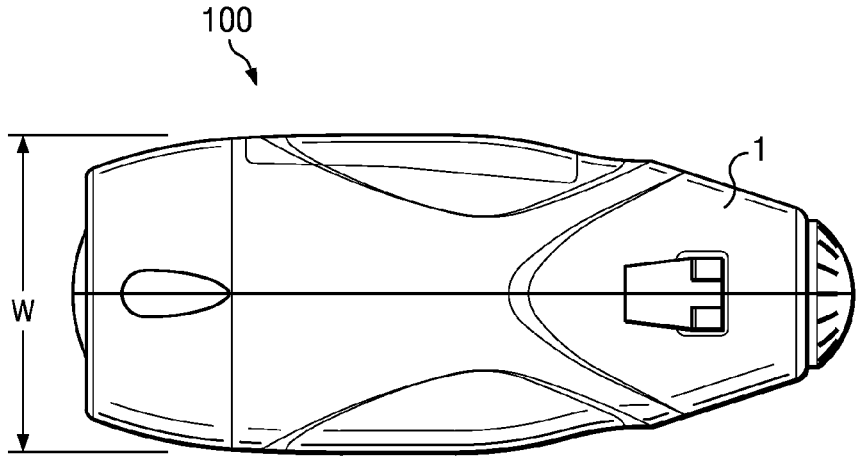
FIG. 14 is a top view of the bubble generating apparatus of FIG. 1, in accordance with the present disclosure.

FIG. 13 is a side view of the bubble generating apparatus 100 or 200 of FIG. 1 or 10, respectively. In FIG. 13, the housing 1 (or 100) has a height H and a length L. FIG. 14 is a top view of the bubble generating apparatus 100 or 200. In FIG. 14, the housing 1 (or 100) has a width W. In an exemplary embodiment of a pistol-shaped toy, the bubble generating apparatus 100 has a length L of 14.0 cm, a height H of 15.0 cm, and a width W of 5.5 cm, although the dimensions may deviate by plus or minus 25% or more.

Figure 15:
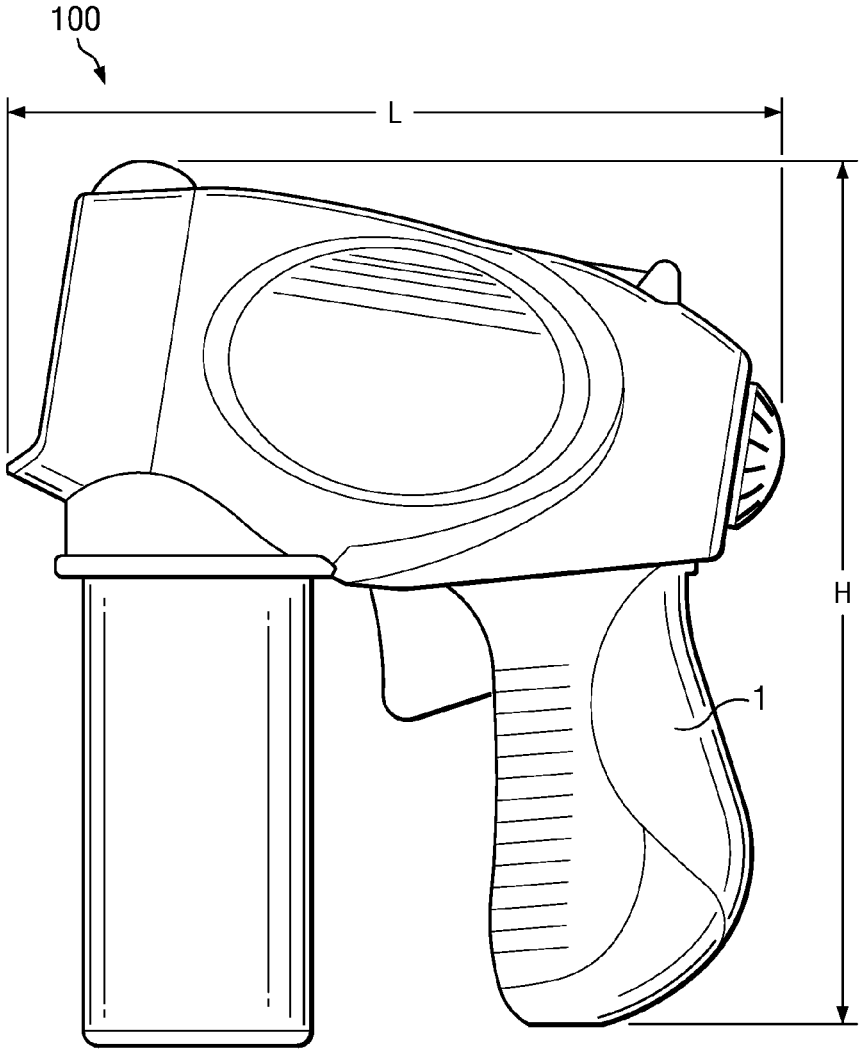
FIG. 15 is a side view of an alternative embodiment of the bubble generating apparatus of FIG. 1, in accordance with the present disclosure.
Figure 16:
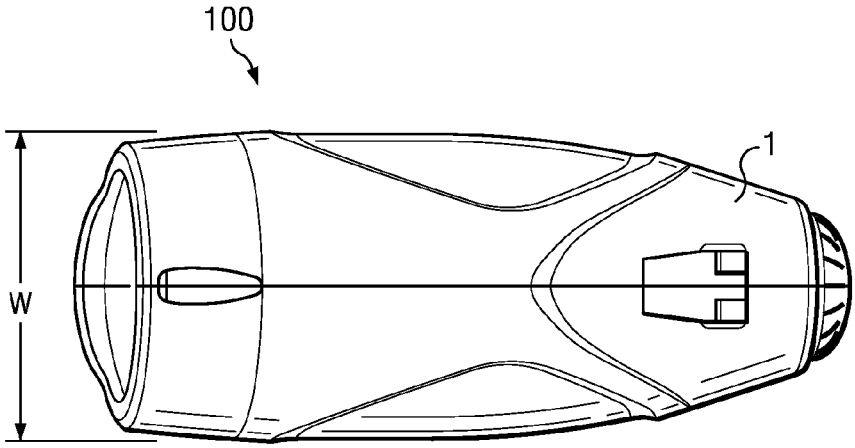
FIG. 16 is a top view of an alternative embodiment of the bubble generating apparatus of FIG. 1, in accordance with the present disclosure.

FIG. 15 is a side view of a bubble generating apparatus 100 or 200 of FIG. 1 or 1, respectively. In FIG. 15, the housing 1 (or 100) has a height H and a length L. FIG. 16 is a top view of an alternative embodiment of the bubble generating apparatus 100. In FIG. 16, the housing 1 (or 100) has a width W. In an exemplary embodiment of a pistol-shaped toy, the bubble generating apparatus 100 has a length 1 of 14.0 cm, a height h of 15.0 cm, and a width w of 5.5 cm. The apparatus 100 is substantially similar to the apparatus 100 in FIGS. 13 and 14 except that the housing opening of the apparatus 100 of FIGS. 13 and 14 is aligned along a substantially vertical plane while the housing opening of the apparatus 100 of FIGS. 15 and 16 is aligned along an inclined plane. Such an inclined orientation of the housing opening may be desirable to produce bubbles moving in a projectile and operable to reach a farther distance. In an exemplary embodiment of a pistol-shaped toy, the bubble generating apparatus 100 has a length L of 14.0 cm, a height H of 15.0 cm, and a width W of 5.5 cm, although the dimensions may deviate by plus or minus 25% or more.

The apparatus of FIGS. 1-16 may be configured in any size or shape optimal for a children's toy, including pistol-shaped, rifle-shaped, or machine gun-shaped, and their corresponding sizes.

Although the present invention has been described in detail, it should be understood that various changes, substitutions, and alterations can be made without departing from the spirit and scope of the invention as defined by the appended claims.

What is claimed is:

1. A bubble generating apparatus, the apparatus comprising:

a housing comprising an internal chamber, an end portion, and a housing opening opposite the end portion; and an output assembly coupled to the housing, the output assembly comprising:

a bubble formation surface having an outward facing ridged area and an aperture defined therethrough, the bubble formation surface being operable to receive a liquid through the aperture, the outward facing ridged area comprising a plurality of ridges disposed adjacent to the aperture, the plurality of ridges comprising alternating elevations and recesses; and first and second shutter flaps, wherein the first and second shutter flaps each define a plane that is substantially parallel to the outwards facing ridged area of the bubble formation surface;

wherein each shutter flap is operable to pivotably rotate from a first orientation to a second orientation;

wherein, when the first and second shutter flaps are in their respective first orientation, the first and second shutter flaps substantially cover the aperture defined through the bubble formation surface, and an edge of the first shutter flap is adjacent to an edge of the second shutter flap, and the first and second shutter flaps are proximate to the bubble formation surface;

wherein, when the first and second shutter flaps are in their respective second orientation, an air flow may be directed along a path through the aperture of the bubble formation surface and through the housing opening; and wherein pivotably rotating the first and second shutter flaps is operable to shear against the outward facing ridged area and spread a film of the liquid across the bubble formation surface as the first and second shutter flaps pivotably rotate across the ridges.

2. The apparatus of claim 1, wherein the first and second shutter flaps each abut a portion of the bubble formation surface when the first and second shutter flaps are in their respective first orientation.

3. The apparatus of claim 1, wherein the first and second shutter flaps are spaced from the bubble formation surface when the first and second shutter flaps are in their respective first orientation.

4. The apparatus of claim 1, wherein the output assembly further comprises a member connected to the bubble formation surface, wherein the member is disposed in the proximate to the aperture and operable to direct the liquid from the aperture to the bubble formation surface.

5. The apparatus of claim 1, wherein the bubble formation surface comprises a plurality of ridges extending therefrom.

6. The apparatus of claim 5, wherein the ridges are disposed circumferentially about the bubble formation surface.

7. The apparatus of claim 1, further comprising a reservoir removably connected to the housing, the reservoir operable to store the liquid, and a flexible tube having a first end extending into the reservoir and a second end connected to the aperture in the bubble formation surface.

8. The apparatus of claim 7, further comprising a motor mounted in the internal chamber of the housing and a pumping mechanism driven by the motor, the pumping mechanism operable to pump the liquid from the reservoir, through the flexible tube, to the aperture in the bubble formation surface.

9. The apparatus of claim 1, further comprising a motor and a fan mounted in an internal chamber of the housing, the fan being driven by the motor.

10. The apparatus of claim 9, further comprising an air cylinder mounted in the internal chamber of the housing, the air cylinder having a first end opening proximate to the fan and a second end opening proximate to the aperture defined through the bubble formation surface, wherein the fan is configured to blow air from the first end of the air cylinder to the second end of the air cylinder and through the aperture defined through the bubble formation surface.

11. The apparatus of claim 10, further comprising:

a reservoir removably connected to the housing, the reservoir operable to store the liquid;

a flexible tube having a first end extending into the reservoir and a second end connected to the aperture in the bubble formation surface; and a pumping mechanism driven by the motor, the pumping mechanism operable to pump the liquid from the reservoir, through the flexible tube, to the aperture in the bubble formation surface.

12. The apparatus of claim 11, wherein the motor is powered by at least one battery.

13. The apparatus of claim 1, wherein the end portion of the housing is an enclosed end portion.

14. The apparatus of claim 1, further comprising a bubble assembly support, wherein a portion of the output assembly is received in a first portion of the bubble assembly support and the first and second shutter flaps of the output assembly are connected to a second portion of the bubble assembly support.

15. A bubble generating apparatus, the apparatus comprising:

a housing comprising an internal chamber, an end portion, and a housing opening opposite the end portion;

an output assembly coupled to the housing, the output assembly comprising:

a bubble formation surface having an outward facing ridged area and an aperture defined therethrough, the bubble formation surface being operable to receive a liquid through the aperture, the outward facing ridged area comprising a plurality of ridges disposed adjacent to the aperture, the plurality of ridges comprising alternating elevations and recesses; and first and second shutter flaps, wherein the first and second shutter flaps each define a plane that is substantially parallel to the outwards facing ridged area of the bubble formation surface;

wherein each shutter flap is operable to pivotably rotate from a first orientation to a second orientation; and a member connected to the bubble formation surface, wherein the member is disposed in the proximate to the aperture and operable to direct the liquid from the aperture to the bubble formation surface;

wherein, when the first and second shutter flaps are in their respective first orientation, the first and second shutter flaps substantially cover the aperture defined through the bubble formation surface, and an edge of the first shutter flap is adjacent to an edge of the second shutter flap, and the first and second shutter flaps are proximate to the bubble formation surface;

wherein, when the first and second shutter flaps are in their respective second orientation, an air flow may be directed along a path through the aperture of the bubble formation surface and through the housing opening; and wherein pivotably rotating the first and second shutter flaps is operable to shear against the outward facing ridged area and spread a film of the liquid across the bubble formation surface as the first and second shutter flaps pivotably rotate across the ridges;

a motor mounted in an internal chamber of the housing;

a fan mounted in the internal chamber of the housing, the fan being driven by the motor and operable to direct the air flow through the aperture of the bubble formation surface;

a reservoir removably connected to the housing, the reservoir operable to store the liquid;

a flexible tube having a first end extending into the reservoir and a second end connected to the aperture in the bubble formation surface; and a pumping mechanism driven by the motor, the pumping mechanism operable to pump the liquid from the reservoir, through the flexible tube, to the aperture in the bubble formation surface.

16. The apparatus of claim 15, further comprising a bubble assembly support, wherein a portion of the output assembly is received in a first portion of the bubble assembly support and the first and second shutter flaps of the output assembly are connected to a second portion of the bubble assembly support.

* * * * *